US006237487B1

(12) United States Patent
Davis

(10) Patent No.: US 6,237,487 B1
(45) Date of Patent: May 29, 2001

(54) SQUEEGEE BLADE HOLDER

(76) Inventor: James R. Davis, 527 Backrus Rd., Webster, NY (US) 14580

( * ) Notice: Subject to any disclaimer, the term of this patent is extended or adjusted under 35 U.S.C. 154(b) by 0 days.

(21) Appl. No.: 09/566,426

(22) Filed: May 8, 2000

(51) Int. Cl.[7] ..... B41F 15/44
(52) U.S. Cl. ..... 101/123; 15/245
(58) Field of Search ..... 101/123, 124, 101/157, 162, 167, 169; 15/236.01, 245, 245.1, 256.5, 256.51, 256.52, 256.53

(56) References Cited

U.S. PATENT DOCUMENTS 2,904,807 * 9/1959 Obergfell ..... 15/105
4,047,480 * 9/1977 Vassiliou ..... 101/123
4,241,691 * 12/1980 Hopfe et al. ..... 118/126
4,841,854 * 6/1989 Bubley ..... 101/123
4,989,512 * 2/1991 Lindstrom et al. ..... 101/123

* cited by examiner

*Primary Examiner*—Ren Yan
(74) *Attorney, Agent, or Firm*—Shlesinger, Fitzsimmons & Shlesinger

(57) ABSTRACT

An elongate, rigid blade holder has in its outer surface an elongate slot which is rectangular in cross section. An elongate, flexible squeegee blade has a first portion thereof extending downwardly into said slot and snugly between the sidewalls thereof. The remaining portion of the blade projects upwardly out of the slot and beyond the outer surface of the holder and has formed thereon at least one longitudinally extending printing edge. Each sidewall of the slot has formed in its upper edge a longitudinally extending recess opening on the outer surface of the holder and on opposite sides of the blade. Each of said recesses has an elongate, flexible blade locking rod removably press fit therein and frictionally engaged with the confronting side of the blade thereby removably securing the blade in the slot.

9 Claims, 1 Drawing Sheet

SQUEEGEE BLADE HOLDER

BACKGROUND OF THE INVENTION

This invention relates to squeegees of the type employed, for example, in screen printing apparatus, and more particularly to an improved such squeegee and blade holder therefor.

It has long been a custom to employ in screen printing apparatus and the like, a squeegee in the form of an elongate rubber blade or the like, which is secured adjacent one marginal edge thereof in a recess in a holder or pair of jaws which can be manipulated to sweep the other edge of the blade along the surface of the screen which is employed for printing purposes. In one such prior art squeegee the handle is made from an elongate piece of wood having an elongate, rectangularly-shaped notch or recess in its lower edge, and with a rubber blade secured adjacent one elongate edge thereof in a recess by staples. In U.S. Design Pat. No. Des. 214,085, a two-piece squeegee is formed by an elongate handle having in one longitudinal edge thereof a nearly circular recess which opens on the bottom of the handle, and which releasably secures therein one longitudinal edge of a rubber blade which has formed thereon a slightly enlarged, nearly circular embossment which is slightly mounted in the circular recess in the bottom of the handle.

In U.S. Pat. No. 5,321,868, an elongate, rigid handle which is rather convexedly shaped along its upper edge, has at its lower edge an elongate, generally rectangularly-shaped notch in which one, correspondingly-shaped edge of a rubber blade is secured frictionally or with adhesive in the rectangular recess in the bottom of a handle. In U.S. Pat. No. 4,276,826, one edge of a rubber blade is secured between a pair of jaws which are carried by screen printing press, and in U.S. Pat. No. 4,047,480 one edge of a rubber blade is secured between two elongate, metal straps which are secured to opposite sides of the blade by a pair of clamps. The blade of U.S. Pat. No. 4,047,840 differs from that disclosed in U.S. Pat. No. 5,321,868 to the extent that its lower, operating edge is generally V-shaped in cross-section, thus presenting one edge for webbing, while the lower edge of the blade in the U.S. Pat. No. 5,321,868 is rectangular in cross-section presenting two spaced, parallel edges either of which can be employed as an operating or wiping edge.

Among the major disadvantages of prior such squeegees is that as a general rule, the blades are extremely difficult to remove from the associated holder to permit the blade to recover chemically and/or physically to its original, for example urethane state, after prolonged use. Moreover most assemblies require tools for mounting the blade in or removing it from an associated handle so very often the blades are seldom if ever removed from the associated handle, and it makes the clamped edge unusable.

In practice, the principle of a squeegee blade is to wipe or screen print on one of the two spaced, parallel lower edges of the blade of the type referred to in above-noted U.S. Pat. No. 5,321,868, or along the one pointed edge the type disclosed in U.S. Pat. No. 4,047,484. Squeegee blades also, typically, are made with different durometers, typically from 50 to 95 durometer. They therefore are flexible in use. Unfortunately, one of the disadvantages of prior art such blades associated handles is the fact that a major portion of the blade projects from or beneath the handle, so that during use, more pressure on the blade results in a dramatic tendency of the blade to flex during use, so that it no longer scapes the printing ink, but instead undesirably plows the ink.

It is an object of this invention, therefore, to provide an improved squeegee comprising a recessed blade holder, and novel means for releasably securing a squeegee blade in the holder.

Still another object of this invention is to provide an improved squeegee of the type described which enables a squeegee blade to be releasably inserted into and removed from its associated holder without the need for employing any special tool.

Still another object of this invention is to provide novel means for releasably securing a squeegee blade in an elongate recess formed in one edge of a blade holder by inserting a portion of the blade along one edge thereof in the holder, and by releasably press fitting a pair of elongate locking rods in shallow recesses formed in the holder at opposite sides of the blade releasably to secure the blade in the holder.

A further object of this invention is to provide a squeegee of the type described in which a substantial portion of a squeegee blade, for example up to 75% thereof, is seated and secured in the recess in the blade holder to minimize the amount of undesirable flex which otherwise occurs with known squeegees during use.

Other objects of the invention would be apparent hereinafter from the specification and from the recital of the appended claims, particularly when read in conjunction with the accompanying drawing.

SUMMARY OF THE INVENTION

An elongate, rigid blade holder has an upper section which is generally rectangular in cross section, and an integral lower section extending downwardly from the tipper section to be utilized for mounting the holder in conventional screen printing apparatus, or the like. Extending downwardly into the upper section of the holder medially of opposite sides thereof is a relatively deep, longitudinally extending slot. Adjacent their upper ends the spaced, confronting sides of the slot have formed therein, spaced, parallel, longitudinally extending recesses or grooves which open on opposite sides of the slot.

To assemble the squeegee, an elongate, flexible squeegee blade which is rectangular in cross section, and which has a thickness approximately equal to the width of the slot in the support, is inserted downwardly into the slot until its lower edge seats on the bottom of the slot. The height of the blade is greater than the depth of the slot and its associated recesses, so that when a blade is seated in the slot, approximately one fourth of the blade projects above the upper surface of the holder. The blade is releasably secured in the slot by two, elongate, flexible, cylindrical locking rods that are manually forced downwardly into the two recesses that are formed in the upper end of the slot so that the locking rods become tangentially and frictionally engaged with opposite sides of the wiper blade, thereby releasably securing the blade snugly in the holder. The blade can be removed simply by removing one or both of the locking rods. For this purpose opposite ends of the recesses accommodating the rods open on opposite ends of the holder so that one end of a respective rod can be pried upwardly out of the associated recess permitting the rod to be gripped and withdrawn manually from the recess thereby permitting removal of the wiper blade simply by removing one or both of the locking rods.

THE DRAWING

PREFERRED EMBODIMENTS OF THE INVENTION

Figure 1:
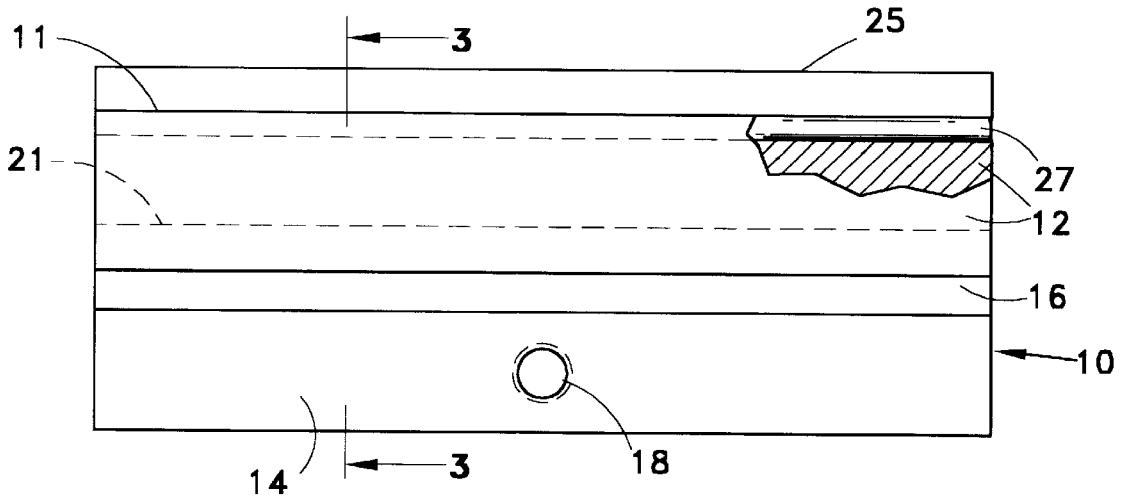
FIG. 1 is a front-elevational view of a squeegee blade and holder therefor made according to one embodiment of this invention, a portion of the holder being broken away and shown in section for purpose of illustration.

Referring now to the drawing by numerals of reference, 10 denotes generally an elongate, rigid, machined or extruded squeegee blade holder substantially the upper half of which is generally rectangular in cross-sectional configuration. This upper section of holder 10 has a plane, flat upper surface 11, and a pair of spaced, parallel outer surfaces 12 and 13 which extend at right angles to the tipper surface 11. Integral with and extending centrally downwardly beneath the upper section of holder 10 is a rectangularly shaped lower or base section which is slightly narrower than the upper section of the holder. This lower section has spaced, parallel outer surfaces 14 and 15 which are connected by inclined surfaces 16 and 17 to the lower edges of the surfaces 12 and 13, respectively. Extending transversely between the surfaces 14 and 15 and centrally through the lower half of the holder 10 is an internally threaded bore 18, which is utilized for mounting the holder 10 in a conventional manner on associated screen printing apparatus or the like, not illustrated.

Figure 3:
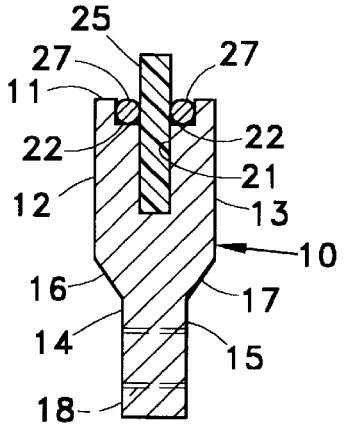
FIG. 3 is a sectional-view taken generally along the line 3—3 in FIG. 1 looking in the direction of the arrow.
Figure 4:
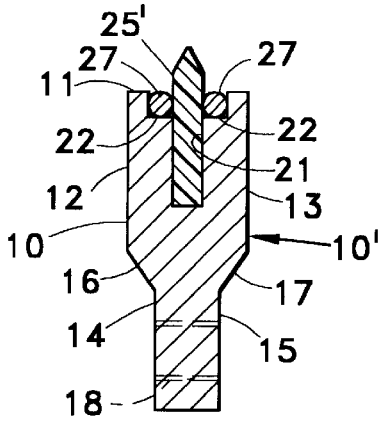
FIG. 4 is a view similar to FIG. 3 though illustrating another type f squeegee blade which can be employed in the holder.

As shown more clearly in FIGS. 3 and 4, the upper section of holder 10 has formed therein medially of its outer surfaces 12 and 13 an elongate, rectangularly shaped blade supporting slot or groove 21 which opens on opposite ends of the holder. Slot 21 extends for a rather substantial distance downwardly into the upper section of holder 10, and at its upper end the opposed sides thereof have formed therein rather shallow, longitudinally extending grooves or recesses 22, which like the slot 21 open on opposite ends of the holder 10, and which are disposed in spaced, confronting, parallel relation to each other.

Figure 2:
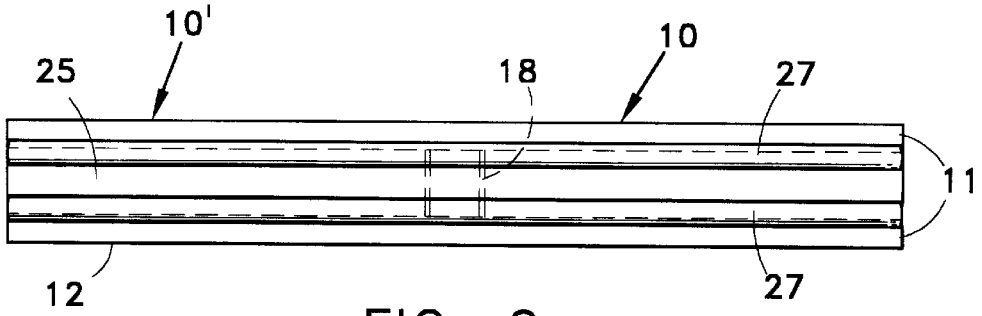
FIG. 2 is a top plan view of this squeegee blade and holder.

Referring to the embodiment as shown in FIGS. 1 to 3, holder 10 has secured in its slot 21 a portion of an elongate, rectangularly shaped, flexible squeegee blade 25, which may be of conventional construction. Typically such blades are made of a flexible, urethane material, and are made with different durometers, typically from 50 to 95 durometer. With reference to the embodiment in question blade 25 has a height substantially greater than the depth of the slot 21, so that a substantial portion of the blade 25 is seated in the slot 21, and perhaps only a quarter of its overall height projects above the upper surface 11 of the holder 10. Also, the blade thickness is approximately equal to the width of the slot 21, so that during assembly of the squeegee the lower portion of the blade 25, such as that shown in FIG. 3, is inserted, manually if desired, downwardly and snugly into the slot 21 until the bottom, plane surface of the blade is seated against the plane bottom surface of the slot 21. Thereafter, in order to secure blade 25 removably in the holder 10, each of two elongate, flexible, cylindrical locking rods 27 is manually pressed or forced into one of the two grooves or recesses 22 which flank opposite sides of the blade 25 when it is seated in the holder 10. The two locking rods 27, each of which has a diameter approximately equal to the depth of a respective recess 22, and slightly greater than the width of the recess, therefore is press fit snugly in a respective recess 22, and in such a manner that opposite sides of the blade 25 are frictionally and tangentially engaged, with the two locking rods 27.

While the foregoing description of the blade 25 and the associated locking rods 27 has been applied to the embodiment shown in FIGS. 1 to 3, it will be apparent, that in essence, the same applies to the embodiment shown in FIG. 4, which is similar to that shown in FIG. 3, except that the upper end of the modified blade 25' is of inverted V-shaped configuration, rather than having a plane upper surface like blade 25.

From the foregoing it will be apparent that the present invention provides relatively simple and inexpensive means for producing an improved squeegee, which can be easily assembled without the need for any special tools, and which also utilizes relatively simple and inexpensive means for releasably securing a blade within the central slot or groove of the blade holder. The blade, 25 or 25', is very easy to remove simply by removing at least one of the locking rods 27, for example by simply prying one end of a respective rod 27 slightly upwardly out of its associated recess 22 after which the rod can be gripped and withdrawn manually form the associated recess 22. This makes the squeegee substantially easier to remove, clean and return into its assembled position as shown in the drawing. Many conventional squeegee assemblies are seldom taken apart because it is very difficult and time consuming to remove and clean and then replace a blade in its associated holder. In the present case, however, the blade 25 or 25' can be quickly and simply inserted into or removed from the associated holder 10. Moreover, since almost three quarters of the height of the respective blade is secured snugly between the opposed sidewalls of the slot 21 in the holder, the blade is secured against undesirable flexing during use.

As will be apparent to one skilled in the art, when a blade such as blade 25 in FIG. 3, has been placed in use in screen printing apparatus or the like, either of the two spaced, parallel, outer edges of its plane upper surface may be employed as a printing edge for wiping or spreading ink during a printing operation. When these two edges have become worn, it is but a simple matter to remove and invert the blade so that its former, upper, previously employed printing edges are now seated in the bottom of slot 21, and the edges thereof that were formerlly positioned in the bottom of slot 21 are now available for use during a printing operation. Blade 25 thus has four useful printing edges. As far as blade 25' is concerned, it will be noted that when its inverted, V-shaped upper edge has become worn, blade 25' can also be inverted to place the two opposed edges on its plane, lower surface (lower surface as shown in FIG. 4) can then be placed in use, thus providing at least three printing edges for blade 25'. If both the upper and the lower surfaces of blade 25' were to be inverted, V-shaped in configuration, then blade 25' would also have at least two different printing edges available for use in the printing operation. Thus, by clamping a squeegee blade in a place other than at its end, the blade is twice as useful for the same price—i.e., two edges instead of one for a blade with V-shaped tipper and lower edges, and four edges instead of two for a blade of rectangular cross section. In any case, as noted above, it is but a simple matter to mount one of the illustrated printing blades in the associated holder 10, and is equally as easy to remove and invert or replace the wiper, if necessary.

While in the illustrated embodiments the locking rods 27 are shown to be cylindrical and removably seated in recesses which are right-angular in cross section, it will be apparent that the exact shape of the rods 27 and the associated recesses 22 could be changed slightly without departing from this invention, provided that such rods and their associated recesses function, as noted above, resiliently to retain the wiper blade 25 or 25' removably in a deep slot in the holder 10.

Moreover, while this application has been illustrated and described in detail in connection with only certain embodiments thereof, it will be apparent to one skilled in the art that this application is intended to cover any such modifications as may fall within the scope of one skilled in the art, or the appended claims.

What is claimed is:

1. A squeegee, comprising an elongate, rigid blade holder having in an outer surface thereof an elongate blade holding slot, said slot having a pair of spaced, confronting side walls formed on said holder, and a bottom wall extending transversely between said side walls, an elongate, flexible squeegee blade having a first portion thereof extending downwardly into said slot and snugly between said sidewall thereof, and a further portion thereof projecting out of said slot beyond said outer surface of said holder and having formed thereon at least one longitudinally extending printing edge, each of said sidewalls of said slot having formed in the outer edge thereof remote from said bottom wall a longitudinally extending recess opening on said slot, and on opposite sides of said blade, and each of said recesses having an elongate blade locking element removably press fit therein and frictionally engaged with the confronting side of said blade removably to secure said blade in said slot.

2. A squeegee as defined in claim 1, wherein said longitudinally extending recesses in said sidewalls of said slot open on opposite ends of said holder.

3. A squeegee as defined in claim 2, wherein each of said blade locking elements comprises a flexible, cylindrically shaped locking rod.

4. A squeegee as defined in claim 1, wherein said first portion of said blade extends downwardly into said slot for a greater distance than said second portion extends beyond said outer surface of said holder.

5. A squeegee as defined in claim 1, wherein said blade and said slot are rectangular in cross section and said blade has a thickness approximately equal to the space separating said slot side walls, and said one printing edge is one of two, laterally spaced, parallel printing edges formed on said further portion of said blade.

6. A squeegee as defined in claim 1, wherein opposite ends of said slot and opposite ends of said recesses open on opposite ends of said holder.

7. A squeegee as defined in claim 1, wherein said blade has a lower edge thereof seated on said bottom wall of said slot, and the extent to which said first portion of said blade projects into said slot is substantially greater than the extent to which said further portion thereof projects beyond said outer surface of said holder.

8. A squeegee as defined in claim 1, wherein said one, longitudinally extending printing edge is inverted U-shaped in cross section.

9. A squeegee as defined in claim 1 wherein each of said recesses is generally L-shaped in configuration and has a bottom surface spaced beneath said outer surface of said holder, and each of said locking elements comprises a flexible, cylindrical locking rod having a diameter approximately equal to the distance from said outer surface of said holder to said bottom surface of the respective recess in which said rod is press fit.

* * * * *